US006533224B1

(12) United States Patent
Ireland

(10) Patent No.: US 6,533,224 B1
(45) Date of Patent: Mar. 18, 2003

(54) POWER AND IMPEDANCE CONTROL METHODS FOR MODEL RAILROADS

(76) Inventor: Anthony John Ireland, 97 Park Dr., Norcross, GA (US) 30071

( * ) Notice: Subject to any disclaimer, the term of this patent is extended or adjusted under 35 U.S.C. 154(b) by 0 days.

(21) Appl. No.: 10/023,684

(22) Filed: Dec. 18, 2001

Related U.S. Application Data

(62) Division of application No. 09/628,818, filed on Jul. 31, 2000, now Pat. No. 6,367,742.

(51) Int. Cl.[7] ..... B61L 3/00

(52) U.S. Cl. ..... 246/187 A; 246/187 R; 246/122 A; 246/1 C; 191/2; 191/3

(58) Field of Search ..... 246/122 R, 122 A, 246/473 A, 1 C, 34 R, 34 B, 50, 187 A, 87, 187 R; 104/295; 191/2, 3, 4, 5; 323/205, 208, 207

(56) References Cited

U.S. PATENT DOCUMENTS 5,448,142 A * 9/1995 Severson et al. ..... 246/187 A
5,773,939 A * 6/1998 Severson et al. ..... 246/187 A
5,896,017 A * 4/1999 Severson et al. ..... 104/276

* cited by examiner

*Primary Examiner*—Mark T. Le

(57) ABSTRACT

Methods are provided for intelligent power management control of model railroad layouts that employ multiple boosters that can be added in a parallel arrangement to increase the power available to a section of track. Boosters paralleled in this method employ circuits and a logic function to detect the actual track voltages they are normally connected to for providing track current, as an alternate to an extra hardware synchronizing link. By detecting the track voltages in this way during the recovery period after a overload fault has cleared, all Matched boosters can accurately determine when the first restarting booster attempts to re-energize the tracks and hence immediately turn on their own power to argument the current available for restarting. This ensures that the boosters can act in synchronized concert to power a track section that they individually cannot drive because the current draw would exceed the individual booster current capacities.

6 Claims, 2 Drawing Sheets

POWER AND IMPEDANCE CONTROL METHODS FOR MODEL RAILROADS

This application is a division of Ser. No. 09/628,818 filed Jul. 31, 2000 now U.S. Pat. No. 6,367,742.

BACKGROUND OF INVENTION

This invention pertains to the field of control systems for scale model railroad layouts, and specifically to elements of the generation and distribution of track power.

Modern layout control systems allow the simultaneous control of many devices that are attached to or run on the tracks of model railroads. As the number of devices in use increases the power required to run them also increases. This leads to the requirement of more powerful boosters or power stations or other devices that deliver the power and control signals to the layout, and schemes to distribute these higher power levels.

Inherent in these boosters, power stations or power sources is the requirement that they safely deliver high power levels in an environment where the tracks may frequently sustain periods where they may be short circuited by, for example; derailed rolling stock, or wheel flanges bridging close rail gaps in the body of track turnouts or track switches.

The current art for model railroad power generation and distribution employs several power management strategies to minimize the disruption to layout operations.

In particular the boosters or other power control elements employ a control strategy to detect the-overload current that occurs when the rails are short-circuited or conductively bridged. If a detected short circuit overload fault persists then the booster power output is turned off or disconnected from the tracks to ensure that an excessive amount of energy is not delivered into a fault condition.

These power management techniques do not work reliably when it is desired to parallel multiple boosters to increase available power in a sub-district of the layout. Increased power levels also require more techniques to safely handle disruptions within a sub-district.

SUMMARY OF INVENTION

The economic necessity of powering multiple track areas within a sub-section of a model railroad layout from a single power source means that interactions may occur due to activities of different items controlled within those sub-sections.

In particular because the sub-district shares a commonality of connections to different areas of track, a short circuit fault anywhere in the sub-district will affect other track sections in that sub-district.

Additional loads within a sub-district may also require the adding of additional current capacity to increase the power available for that sub-district.

Signal cross-talk between different track areas in the same sub-district may harm other communication or control signal systems.

The power management and impedance control technique resented in this invention solve some fundamental problems related to having multiple track sections connected in common to a single power source.

ATTACHED DRAWINGS: (2 SHEETS)

Figure 1:
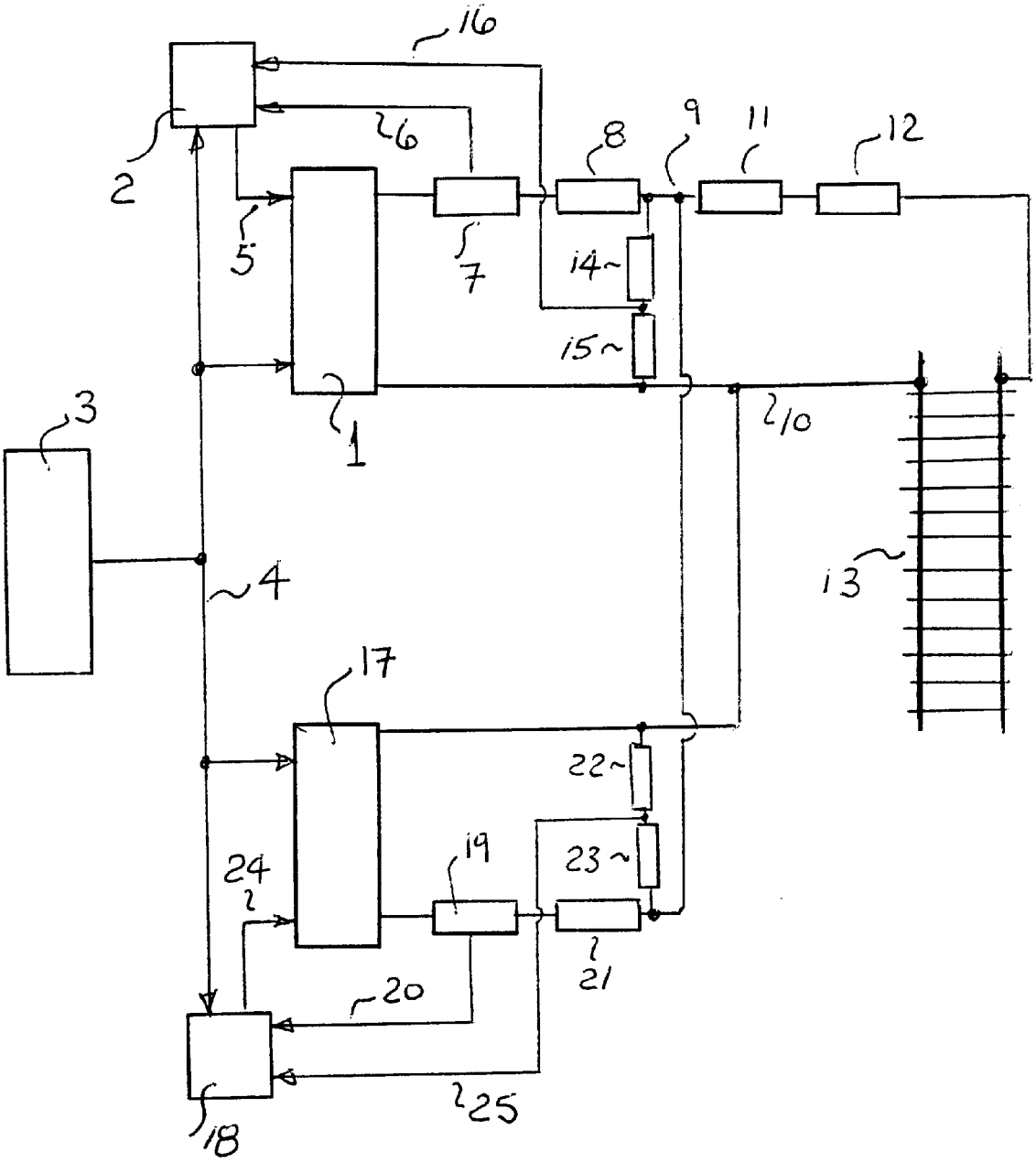
Figure 2:
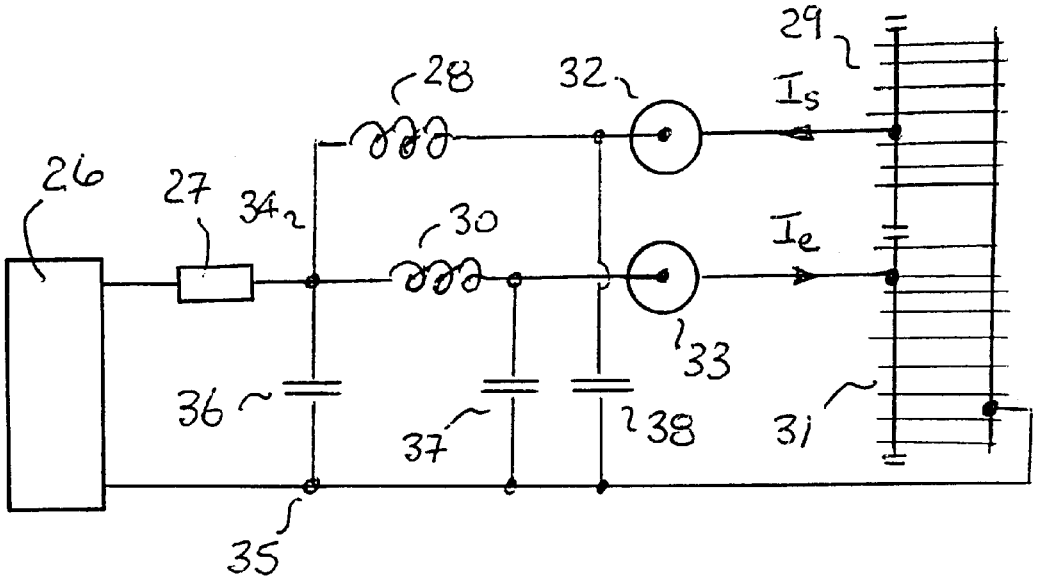
Figure 3:
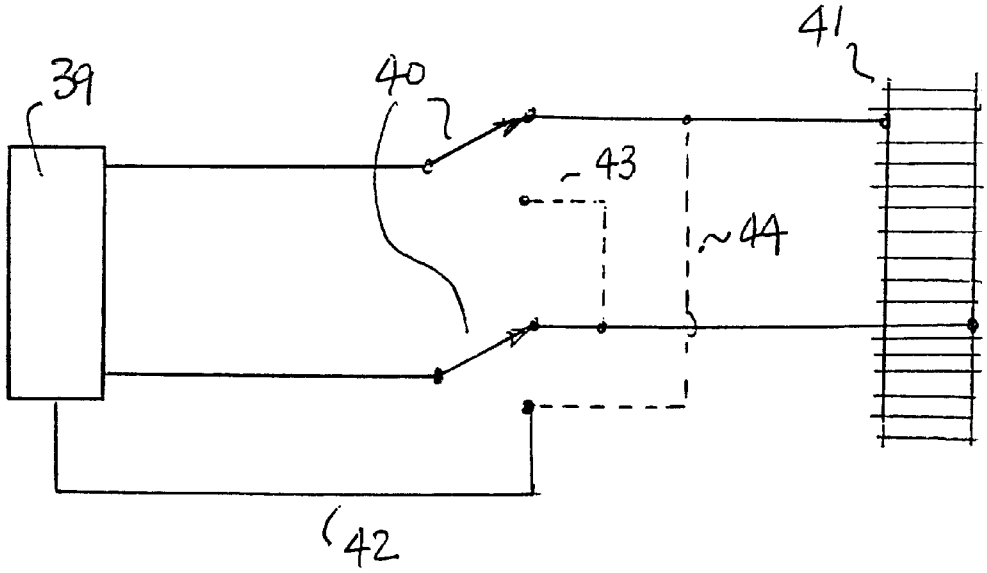

FIG. 1 details the circuit arrangement of the electronic modules that arc used to drive the tracks of a model railroad layout FIG. 2 is a schematic diagram of two track areas connected to a common booster with additional control impedances FIG. 3 is a schematic of an improved design capable of isolate short circuit faults or being configured for automated track polarity reversing.

DETAILED DESCRIPTION OF INVENTION

Element 1 in FIG. 1 represents the power control section of a booster that appropriately switches, or modulates, supplied input power to create an encoded control voltage signal that is then ultimately conducted to item 13. the model railroad tracks, and any other attached devices.

This element 1 is the core of a typical track power booster. The layout control signal that is boosted or amplified by the booster is generated by a master control unit, item 3, and is conducted to the booster by the connecting link, item 4. The booster control logic is encompassed in item 2, which controls the overall actions of the booster. The booster control logic 2, at a minimum, checks for the presence of an appropriate control signal on the connecting link 4 and if this is not present and of the correct nature, will then turn off the power control unit 1 via the output control connection 5. In this way the booster will only create track power, or energize the tracks if it is properly connected to the rest of the layout control system. The arrows are included for clarity to show the direction that information is carried on the control links or connections.

Additionally, the booster control logic, 2, monitors the current delivered by item 1 to the layout via a current sensor, 7, which signals this current value via link 6. If a short circuit occurs on the layout tracks, large overload currents will flow from the power control unit, 1, and be detected by 7 and thus be communicated to the booster control logic, 2 by link 6. The booster control logic can then implement a hardware or software strategy to the limit the magnitude and duration of the overload current by turning off the booster output power using output control link 5, or even lowering the output voltage driven by item 1. This control action is termed "intelligent power management" and allows safe levels of power to be delivered to the layout, even when nishaps may occur in operation.

The booster control logic, 2, must discriminate between the maximum continuous load current permitted and the greater current due to a short circuit fault. This maximum continuous load current defines the booster current capacity or rating.

In fault conditions the total booster output energy to the layout is limited by the booster control logic such that the risk of fire or damage is minimized. The booster control logic may automatically and periodically try to restart or re-energize a faulted track section. This is the current state of the art for powering model railroad layouts. In this discussion the connection to and isolation from the main electrical power source is not explicitly covered since it is similar and common to all systems.

The equivalent electrical output impedance of the power control section of the booster is represented by item 8. This is determined by the design of the booster power control section and may also be additionally augmented by logic that introduces an additional output voltage droop proportional to load current at a predetermined level the impedance of the feeder wire corrections to the track is represented by item 11. Item 12 represents additional impedance that may be added to the feeders, for example to limit the maximum value of short circuit currents. Items 9 and 10 represent the output connection terminals of the booster. These three impedances form part of a fixed conducting path or loop for current flow into and out of the booster power control section. The load impedance connected across the track or feeders completes the path for current flow and defines the normal operating current. The load impedance may change often during operation, reflecting the varying power usage of items being controlled on the layout.

If a short circuit occurs across the rails or track feeds, assuming a worst-case of a zero impedance across the tracks, then common electrical analysis techniques indicate the booster output voltage divided by the sum of the loop impedances 8, 11 and 12 defines the magnitude of the resulting maximum or worst-case current. If the sum of all the loop impedances is low enough then the resulting current will exceed the booster current capacity, and be detectable as an excessive value requiring intervention for safety reasons.

During this short circuit condition the voltage on the booster output terminals 9 and 10 will be reduced due to the voltage divider action of loop impedances 8, 11 and 12. This is the case because a short circuit at the track effectively adds to the conduction loop the very low extra impedance shunted across the tracks. In this analysis, this is assumed to be a impedance of zero, although it is also possible to account for the effect any small non-zero impedance into the feed impedance, item 11. Note that for simplicity of analysis the impedances 8, 11 and 12 are shown in a single lead of the booster. In actuality the impedances are typically split equally in balance between both booster terminals and track feeds.

As more power consuming devices are added to a layout, a point is reached where the booster capacity is exceeded. A booster with higher current rating may then be used, but this is not always the best solution. In particular, in many parts of the layout a higher power booster is not needed. It is preferable to subdivide the layout into many sub-districts each driven by a separate booster with a lower capacity. This has the benefit of minimizing interruptions to the whole layout when a single sub-district has a fault, whilst still delivering sufficient total layout current as the sum of all the booster ratings. In some sub-districts it may be desirable to have a booster capacity greater than other sub-districts, for example where extra lamp or light loads may be present. In this situation it is advantageous if it possible to parallel two boosters to double the capacity in a sub-district. Unfortunately the use of intelligent power management makes this problematic, since the short circuit protection logic sections interact in an unstable manner. In particular, the correct fault recovery, or restarting, of a pair of paralleled boosters into a load that is greater than either can handle individually requires an extra synchronization link between the booster control logic of both boosters. This is; inconvenient, an extra wiring complexity and becomes unmanageable if more than two boosters are to be connected in parallel.

To allow for an improved synchronization method for parallel connection of boosters, this invention employs an additional voltage sensing divider network, items 14 and 15 across the booster output terminals, 9 and 10.

The booster control logic can now obtain a representative sample of the booster output voltage via the output voltage sample link 16. This allows for additional fault control possibilities not available when faults are detected solely by sensing the booster current using current sensor 7.

The power control section of an additional booster, 17, is shown in FIG. 1 as parallel connected to the terminals 9 and 10 of the first booster. This second booster contains identical logic, control and elements as the first booster. In particular, it receives layout control signals via link 4, has a booster control logic section 18, a current sensor, 19, equivalent output impedance, 21, and a voltage sensing divider network 22 and 23. Link 24 controls the output of the power control section, link 20 senses the booster current and link 25 senses the output voltage of the power control section. These elements all act in the same manner as the corresponding elements of the first booster.

A short circuit experienced with these two paralleled boosters will be detected by both current sensors 7 and 19 at the same time and allow both booster control logic sections to turn off their associated power control sections, as occurs with normal intelligent power management techniques. The only difference is that a higher short circuit current flow may be possible since the equivalent output impedance of the first booster, 8 and that of the second booster, 21 are effectively in parallel in the current loop, so that the total loop impedance is necessarily lower. Note that, assuming the two boosters' power control sections drive closely matched voltages, the contribution of currents from each booster is controlled by the ratio of their output impedances, items 8 and 21. The closer that the voltages and output impedances of the power control sections of the boosters are matched, the more evenly the two boosters will share both normal operating currents and short circuit currents. An equal match then assures a maximum possible combined current capacity that is the sum of the two individual booster current capacities.

After a sensible recovery delay, the intelligent power management strategy contained in the booster control logic sections, 2 and 18, will attempt to re-energize their associated booster output sections to see if the short circuit has been removed. With a track load that exceeds the rating of neither individual booster, the recovery re-energizing must occur at the same time, otherwise the first booster to turn on will see an immediate current overload. A small re-synchronizing delay period, or window, may be added so that the first booster to re-energize ignores any overload for a period that allows another booster to also switch on and contribute load current. However, for reliable operation an extra re-synchronizing link is required between the booster control logic sections. This is because the re-synchronizing delay needs to be as short as possible and there is a timing uncertainty between the recovery delays of different booster control logic sections.

Whilst the initial short circuit event is perceived at essentially the same instant by each booster control logic sections there is no equivalent current detection event possible for re-synchronizing a booster that reentries at a later recovery delay. Thus the current state of the art requires that an extra synchronizing link be provided between all paralleled boosters to ensure reliable power management.

This invention recognizes that during the recovery delay all attached boosters have their power control sections de-energized and do not feed voltage to the track. The booster with the shortest recovery delay will be first to attempt to re-energize the tracks and feeders that all boosters are connected to. Even though this booster will immediately see an excessive current load, the common connection terminals of all the paralleled boosters, items 9 and 10, will now have a voltage that is not zero, or un-energized. Using the output voltage sample link, items 16 or 25 or equivalent, any non-energized booster can then detect this voltage from the first restarting booster and immediately turn on its power control section to then augment the available current for restarting. The advantage of this invention is that all the necessary connections are already made between paralleled boosters, and the only addition required is the provision of the output voltage sensing divider network and the associated output voltage sample link to the booster control logic which can be contained within the booster. Additionally this invention may be expanded to control more than just two boosters connected in parallel by simply adding as many as desired.

It is advantageous to arrange the minimum recovery delay any booster experiences to be longer than the maximum time taken to detect a short circuit fault, thus ensuring all boosters will be in some portion of the recovery delay before any restart is attempted.

A further benefit of this invention is that if a single booster in the paralleled combination is shut down for any reason, for example if it has an automatic over-temperature safety shut-down or a user switches off its output manually, then a resulting overload on the other boosters will force all of them to shut down and only properly restart when the event causing the shutdown has ended.

The electrical circuits and components that implement the booster power control section, booster control logic section and other parts of the booster are not explicitly drawn or included since they may be designed from the information specified in this disclosure by any person skilled in the art of; electronic circuit design, software design and design of control systems and still retain the spirit of this invention. In particular, a key component in this invention is the provision of the voltage sensing divider network, items 14 and 15, or items 22 and 23, in FIG. 1, and the subsequent interpretation of the information that this network provides. Note that the actual ratio of the impedances of elements 14 to 15, or elements 23 to 22 set the divider division ratio for the fraction of the output voltage that is available to the output voltage sample link. This division ratio may be set to any value that is advantageous to the circuit design, and obviously includes the cases when one of the impedances is deleted or the other is of zero value, such that the divider ratio is set to unity.

The addition of the extra impedance item 12 may be beneficial to equalize and limit the maximum short circuit currents that occur in different parts of the layout with shorter feed lengths versus parts of the layout further away that have higher feed impedances, and consequently smaller short circuit currents. In this situation there may be a multiplicity of sets of feeder impedance 11 and extra impedance 12, from each track area independently collected to the booster terminals, items 9 and 10. It is beneficial to booster power control section reliability that the maximum short circuit currents be constrained to values that do not cause hazardous electrical stresses on the internal components. Likewise the contrast between booster capacity current and the higher threshold value for deciding the presence of a short circuit condition is best to be clearly defined and controlled. Typically this extra impedance 12 is of a low value so as not to incur excessive voltage losses during normal operation. It is common model railroad practice to in fact use the non-linear negative resistance of 12 volt car lamps to act as ballast impedances to control short circuit conditions in this manner.

The benefit of the extra impedance 12 may be further extended if it contains inductive reactance in addition to a resistive, or real, impedance characteristic. In this condition the extra reactance component of impedance 12 acting in series with the track loads allows for isolation or mitigating of the interactions of currents flowing in different track sections.

FIG. 2 shows the simplified equivalent circuit of a booster power control section, 26, driving a track section 29 via its output impedance and extra impedance 28, denoted as an inductor to highlight its primarily reactive nature. An additional track section 31 is also connected to the same booster power control section, 26, via an extra inductive impedance, 30 and item 27. The booster power control section may be a single unit or consist of paralleled units. The track feed impedance denoted as item 11 in FIG. 1 is not shown in this drawing because it typically has an impedance that is smaller than the inductive reactance chosen for items 28 or 30 and so has minimal impact on this analysis.

This arrangement is very beneficial when a high frequency current sensor, item 32 is employed to detect information from a device attached to track section 29. In this case the high frequency signal current, Is, generated by a device in track section 29 in FIG. 2, flows through the high frequency current sensor 32, reactance 28 and through output impedance 27 and thence back, via node 35, to its return rail to complete the circuit or current loop. The passage of this signal through impedance 27 causes an extra voltage, Vs, to be developed between points 34 and 35, which is then common to all track sections connected to 26. If there is a device on track section 31 drawing current, this will be affected by the newly induced additional common voltage, Vs, and hence will result in a sympathetic or echo current, Ie, flowing through the second high frequency current sensor 33. The phase or direction of the initial signal current, Is, and the induced echo, Ie, is opposite or reversed as the arrows suggest. This echo current, Ie, may falsely trip the high frequency current detector 33 even when no signaling current is being generated in track section 31, depending on the current levels, impedances and current detection threshold of sensor 33. This is considered cross-talk or interference between independent track sections that share a common booster power control section and impedances.

The reactance of element 28 may be used to filter this interaction through the common booster and any feeder impedance that may also be common to track sections. Consider the addition of the capacitor 36 across the nodes 34 and 35, that have the extra induced common voltage Vs. The capacitive reactance of 36 lowers with increasing frequency and tends to shunt or short out the induced voltage Vs to the common node 35. Additionally the reactance of 28 increases with frequency and forms a frequency selective voltage divider network with the combination of 36, 26 and other impedances connected across nodes 34 and 35. This filtering is a classic electrical "L section" filter arrangement.

The reactance values of 28 and 36 are chosen to provide filtering out of the high frequency signal, Is, from nodes 34 and 35, whilst still permitting acceptable passage of the track control voltage waveform driven by the booster power control section 26. Typically the high frequency signal, Is, is ten or more times higher in frequency than the track control waveform and so the filtering can be quite effective. If a second capacitor 37 is added as shown in FIG. 2, then another filter stage is created to suppress the voltage Vs, this time it is the frequency sensitive voltage divider effect of inductive reactance 30 with capacitive reactance 37. In fact the combination of elements 36 30 and 37 form a classic "Pi section" filter with much higher attenuation than a single L section filter. In this analysis the series inductive impedances 28 and 30 and parallel capacitances 36 and 37 have been shown to filter the signal Is, originating in track section 29, from causing an effect in track section 31.

If capacitor 38 is added then the circuit arrangement becomes fully symmetrical and by the same type of filtering analysis just presented, track section 29 and sensor 32 can be protected from cross-talk currents and voltages induced from unrelated signaling currents in track section 31. Thus the addition of carefully designed and connected additional impedances into the track power generation and distribution scheme of a model railroad may greatly improve the operations on the layout.

The electrical schematic presented in FIG. 2 is simplified to aid comprehension. In reality the impedances noted may exist in both legs of the wiring, feeders, boosters and connections, but the beneficial filtering effects claimed by this invention will still occur.

The output control connection 5 in FIG. 1 allows the power control section of the booster to be turned off and de-energize the tracks and feeders. In most booster circuit realizations the power control section is implemented with semiconductor switching devices that can be turned off by removing their control signals. An additional possibility is the use of an additional electrical relay downstream of the booster to disconnect the output from the semiconductor switching devices to the track feeders and layout.

Several commercial products now exist that provide either short circuit management or automated reversing with relay modules external to the booster.

The use of a double pole change-over relay as shown in FIG. 3 to de-energize the booster output allows the possibility of the relay being used to simply turn off the booster output. An additional possibility is that a connection, plug or jumper arrangement can be configured to allow the simple conversion of this relay to be alternatively used for automated reverse section control. If an additional voltage sensing network connection is provided at the relay terminals, then the control logic can automatically determine what type of usage the relay is strapped for and modify the control logic from short circuit disconnection protection to automated reversing control. A further refinement is to incorporate this control relay, or even a multiplicity of them, within the actual booster design so as to allow a single chassis to provide multiple booster outputs with configurable functions.

What is claimed:

1. A method for synchronizing power sequencing of a multiplicity of model railroad boosters connected in parallel arrangement, comprising at least:

connecting said multiplicity of model railroad boosters in a parallel arrangement, providing a power control section means to provide encoded track control voltages at booster output connection terminals connected in said parallel arrangement, providing an output voltage sample link means to provide a representative voltage sample of said encoded track control voltages at said booster output connection terminals, providing a current sensing means to provide a representative current sample of output current provided at said booster output connection terminals, providing a booster control logic means for detecting overload current conditions from said representative current sample and the logic means including an intelligent power management strategy can that at least generates a fault recovery delay after detection of said overload current conditions and where said fault recovery delay may be terminated by detection of said representative voltage sample that indicates any first restarting booster during said fault recovery delay, providing an output control collection means to allow said encoded track control voltages at said booster output connection terminals to be controlled by said intelligent power management strategy employed by said booster control logic means in response to said overload current conditions and said fault recovery delay, and synchronizing turning on of all said boosters connected in said parallel arrangement by a termination of said fault recovery delay by detection of said representative voltage sample that indicates any first restarting booster during said fault recovery delay.

2. The method defined in claim 1 wherein said encoded track control voltages are bipolar digital control signals.

3. The method defined in claim 2 wherein said encoded track bipolar digital control signals are encoded by a digital command control standard encoding method.

4. The method defined in claim 1 wherein said encoded track control voltages are Direct Current control signals.

5. The method defined in claim 1 wherein said encoded track control voltages are Altemating Current control signals.

6. The method defined in claim 1 further comprising a track voltage sensing divider network means to allow additional fault detection possibilities not solely dependent on said current sensing means.

* * * * *